United States Patent [19]

Crompton

[11] 3,980,878

[45] Sept. 14, 1976

[54] VEHICULAR SIGNAL LAMP

[75] Inventor: Kenneth J. Crompton, Willowdale, Calif.

[73] Assignee: Dominion Auto Accessories Limited, Toronto, Canada

[22] Filed: Jan. 17, 1975

[21] Appl. No.: 541,846

[52] U.S. Cl. ..... 240/7.1 R; 240/41 BM; 240/90; 240/153; 339/119 L; 339/125 L

[51] Int. Cl.[2] ..... F21V 15/04

[58] Field of Search ..... 240/41 BM, 90, 153, 240/7.1 R; 339/119 L, 125 L, 221 L

[56] References Cited

UNITED STATES PATENTS

| | | | |
|---|---|---|---|
| 3,059,104 | 10/1962 | Dickson | 240/90 X |
| 3,529,149 | 9/1970 | Dwyer | 240/90 |

*Primary Examiner*—Richard A. Wintercorn

*Attorney, Agent, or Firm*—Barnes, Kisselle, Raisch & Choate

[57] ABSTRACT

A vehicle signal lamp comprising a housing of generally cup-shaped configuration having an open end which is closed by a suitable lens member. The housing has two integral pads upon which a resilient member is mounted. The resilient member has two resilient ears which engage recesses in the pads on the housing and an integral tubular member between the ears. A socket member is telescoped within the tubular member and is adapted to receive a contact member, a compression member, a bulb and the required electrical leads. The resilient member is constructed to enhance the dampening of vibrations and mild shocks, while offering sufficient physical resistance to severe shocks which are less frequently encountered.

16 Claims, 3 Drawing Figures

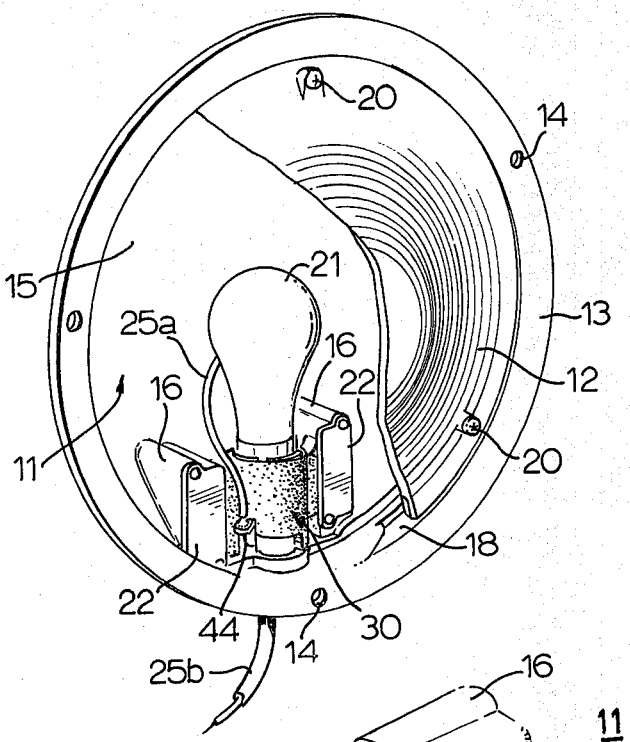
FIG. 1
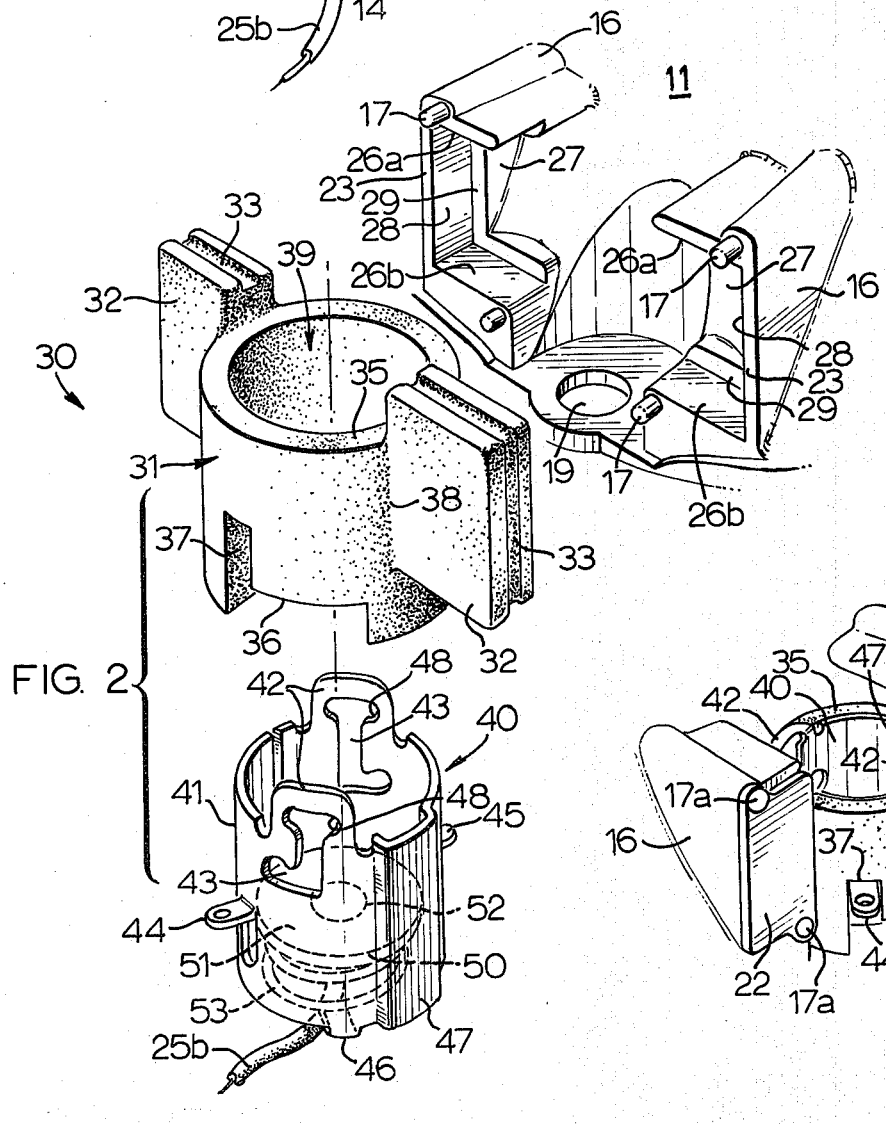
FIG. 2
FIG. 3
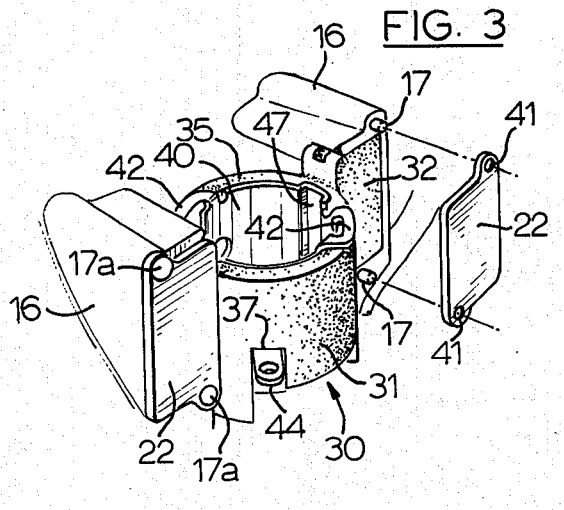

VEHICULAR SIGNAL LAMP

This invention relates to vehicular lamps and particularly to those utilized on highway vehicles where exposure to severe shock and vibration is experienced.

BACKGROUND OF THE INVENTION

In commercial vehicles, a common cause of lamp failure is bulb filament breakage. This is brought about by the continuous exposure of the lamp to severe shock and chassis vibration.

Numerous devices have been previously proposed, attempting to reduce such shock and vibration related failures. None has been fully successful, inasmuch as the frequencies and amplitudes of shock and vibration are too wide-ranged to permit simple solution. Most devices previously disclosed have had beneficial results regarding isolation of mild vibration, but severe shock isolation has only been accomplished heretofore by means which substantially defeated vibration isolation characteristics.

Shock tests for vehicle lamps are severe and range from an 18 inch - 60 lb. drop force at a frequency of 750 cycles/minute (SAE-J577) to a 25 G force load for 7 milliseconds (MIL-STD-202). Consequently, obvious methods of cushioning lamp bulb filaments are inadequate since considerable physical damage is caused under minimum test procedures.

An object of the present invention is the generation of lamp which offers resistance to bulb failure due to mild shock and vibration, while simultaneously resisting physical damage from high shock loads.

A further object of the invention is the provision of a suitable lamp which is relatively inexpensive to fabricate and may be readily assembled without the need for a complex procedure.

SUMMARY OF THE INVENTION

In accordance with the invention, the lamp embodying the invention comprises a housing of generally cup-shaped configuration, which has an open end which is closed by a suitable lens member. The housing includes two integral pads upon which a resilient member is mounted. The resilient member has two resilient ears which engage recesses in the pads on the housing and an integral tubular member between the ears. A socket member is telescoped within the tubular member and is adapted to receive a contact member, a compression member, a bulb and the required electrical leads. The resilient member is constructed to enhance the dampening of vibrations and mild shocks, while offering sufficient physical resistance to severe shocks which are less frequently encountered.

DESCRIPTION OF THE DRAWINGS

FIG. 1 is a part sectional perspective view of a lamp embodying the invention.

FIG. 2 is a fragmentary exploded view of a portion of the lamp shown in FIG. 1.

FIG. 3 is a fragmentary perspective view of the portion of the lamp shown in FIG. 2 in partially assembled relation.

DESCRIPTION

Referring to FIG. 1, lamp 10 embodying the invention comprises a generally cup-shaped housing member 11 of plastic or metal and a lens 12 of transparent plastic material closing the open end of housing 11. Two pads 16 are provided integral with the inner surface 15 of housing member 11. Pads 16 comprise opposing identical recesses 27 adapted to receive bulb support means 30, as presently described. In this embodiment, housing 11 comprises an arcuate rear surface 15, terminating peripherally at a circumferential generally axially extending ledge 18. An integral mounting flange 13 is disposed about the periphery of housing 11. Openings 15 in the flange 13 provide a means for mounting the lamp. Lens 12 may be secured by any adequate means, in the present configuration this is accomplished by screws 20 threaded into the housing 11.

Bulb assembly 30 is maintained in the designated mounting recesses 27, as presently described. Bulb holder assembly 30 comprises two major components: a resilient bulb socket holder member 31 and a bulb socket 40 securely fastened therein. When combined, these components provide a relatively rigid general assembly 30 comprising integral shock and vibration resisting characteristics when inserted into mounting recesses 27 of the housing 11.

The resilient bulb socket holder member 31 comprises a cylindrical or tubular portion 39 of suitable thickness having a top edge surface 35 and a bottom edge surface 36. Projecting radially from the cylindrical section 39 are two integral rectangular ears 32, preferably in coplanar relation. Ears 32 have grooves 33 about the periphery spaced from the opposed surfaces thereof to facilitate tolerance take-up when mounted. The ears 32 are integral with cylindrical section 39 and flexibility is provided at intermediate areas 38 at the area of juncture of tubular portion 39 on the ears 32. When the bulb holder assembly 30 is installed into the housing 11 and retained by plates 22, omnidirectional movement is provided by the flexibility in the intermediate areas 38.

Bulb retention is provided by socket member 40 which telescopes into cylindrical portion 39 of resilient member 31. Socket member 40 comprises a tubular section 41. Tubular section 41 includes integral locking loops 42 which are bent downwardly and outwardly as shown in FIG. 3, when the section 41 is telescoped into the cylindrical portion 39, to prevent axial movement of the section in one direction. Tabs 44, 45 are bent outwardly from the section 41 and extend into axial slots in the lower edge of the cylindrical portion 39 of the resilient member 31 to prevent movement of the socket member 40 in the opposite direction. Section 41 is formed with bayonet slots 43 so that when the locking wings 42 are bent outwardly, the upper ends of the slots 43 are open to receive the pins of a bulb. Inwardly extending tabs 46 are provided on the lower end of the tubular section 41 to retain the compression spring 53 within the housing. The compression spring 53 engages the insulating plate 51 that bears the bulb contact 52.

The bulb engagement slots 43 are flared at their upper ends 48 to provide an opening through which bulb pins may pass. Tab 44 is also used to provide electrical contact between the socket member 40 and the housing 11 via wire **25*a*. Positive electrical contact is provided by means of contact assembly 50 which comprises a bulb contact 52, an insulating plate 51 and lead 25*b*. In order to properly tension the bulb 21 in the slots 43, a compression device 53 (in this embodiment a wire spring) is provided. Socket member 40 includes an axially extending embossed area or projection 47** which serves to prevent turning of the socket member 40 in the resilient member 31. In this way, accurate control of the filament attitude and thereby photometric efficiency is realized.

The housing 11 is suitably formed in the area of pads 16 to accommodate the bulb holder assembly 30. Recesses 27 are of suitable shape and are provided with plural support ledges 29 lying in a single plane, opposed end walls 28 and opposed side walls 26*a* and 26*b*. Placement of the bulb holder assembly 30 precludes significant movement. The size and shape of each recess is such that the respective ear fits snugly into the recess. Grooves 33 permit sufficient compression of the ears to accommodate manufacturing tolerances. After insertion of the bulb holder assembly 30 into the recesses 27, plates 22 comprising openings 41 are placed over laterally extending ear portions 32 of the resilient member 31 of the bulb holder assembly 30. Openings 41 are mated to upstanding pins 17 and upper surface areas thereafter peened to form locking heads 17*a* which serve as fastening means.

When assembled, the ears substantially fill the recess formed by the flanges 29 and walls 28, 26*a*, 26*b*, and when the plates are placed and peened in position, the mass of its respective ear 32 is compressed. The recesses 33 provide sufficient resiliency to take care of manufacturing tolerances. In use, the vibration and shock isolation of the bulb filament is achieved by the resiliency in the intermediate areas 38 since the ears 32 are firmly held in the respective recesses.

In use, it has been found that the vehicular lamp made in accordance with the invention provides a safeguard of the bulb filament, both under conditions of mild vibration and severe shock. It has been found that the lamp embodying the invention will withstand the aforementioned shock tests.

This invention may be applied to lighting devices utilizing stud mounting means, pedestal mounting means and the like. The particular embodiment shown herein is representative in that the bulb retention assembly would remain the same.

I claim:

1. In a vehicle signal lamp, the combination comprising a housing having an open end, a lens closing the open end of the housing, a bulb holder assembly comprising a bulb socket holder member of resilient material and a relatively rigid socket member, said bulb socket holder member comprising a tubular portion and a pair of integral solid ears extending axially along said tubular portion and radially from said tubular portion and having generally flat opposed surfaces, said housing having radially inwardly opening recesses complementary to said ears, the dimensions of said recesses and said ears being such that said ears substantially fill said recesses, and means for clamping said ears and said recesses against movement between said ears and said recesses, said socket member comprising a tubular section telescoped within said tubular portion of said resilient member, such that upon vibration or shock of said signal lamp, the resiliency in the intermediate portion joining said ears to said tubular portion of said resilient member protects the bulb filament against vibration and shock.

2. The combination set forth in claim 1 wherein said means for clamping said ears in said recess comprises plates engaging said ears and fixed to said housing.

3. The combination set forth in claim 1 wherein said ears have grooves in the peripheral edges thereof providing for slight compression of said ears when they are clamped in position.

4. In a vehicle signal lamp, the combination comprising a housing having an open end, a lens closing the open end of the housing, a bulb holder assembly comprising a bulb socket holder member of resilient material and a relatively rigid socket member, said bulb socket holder member comprising a cylindrical portion and a pair of integral solid rectangular ears extending axially along said cylindrical portion and radially from said cylindrical portion and joined thereto by an intermediate portion, said ears having generally flat opposed surfaces, said housing having radially inwardly opening rectangular recesses complementary to said ears, the dimensions of said recesses and said ears being such that said ears substantially fill said recesses, said means for clamping said ears and said recesses against movement between said ears and said recesses comprising plates engaging said ears and fixed to said housing, said ears have grooving in the peripheral edges thereof providing for slight compression of said ears when they are clamped in position, said socket member comprising a cylindrical section telescoped within said cylindrical portion of said resilient member, such that upon vibration or shock of said signal lamp, the resiliency in the intermediate portion joining said ears to said cylindrical portion of said resilient member protects the bulb filament against vibration and shock.

5. In a vehicle signal lamp, the combination comprising a housing having an open end, a lens closing the open end of the housing, a bulb holder assembly comprising a bulb socket holder member of resilient material and a relatively rigid socket member, said bulb socket holder member comprising a tubular portion and a pair of integral solid ears extending radially from said tubular portion and having generally flat opposed surfaces, said housing having recesses complementary to said ears, the dimensions of said recesses and said ears being such that said ears substantially fill said recesses, and means for clamping said ears and said recesses against movement between said ears and said recesses, said socket member comprising a tublar section telescoped within said tubular portion of said resilient member, such that upon vibration or shock of said signal lamp, the resiliency in the intermediate portion joining said ears to said tubular portion of said resilient member protects the bulb filament against vibration and shock, axially extending ears bent downwardly over the one end of said cylindrical portion of said bulb socket holder member, said ears preventing axial movement of the socket member in one direction, bayonet slots in said socket member extending into said wings such that when said wings are bent downwardly, the open ends of said slots define pin receiving slots for receiving the pin of a bulb.

6. The combination set forth in claim 5 including at least one inwardly extending tab on an opposed end of said tubular section adapted to retain contact members in said tubular section.

7. The combination set forth in claim 5 including at least one tab bent outwardly from the tubular section and extending into a slot in said bulb socket holder member for preventing axial movement of said socket member section in the opposite direction.

8. In a vehicle signal lamp, the combination comprising a housing having an open end, a lens closing the open end of the housing, a bulb holder assembly comprising a bulb socket holder member of resilient material and a relatively rigid socket member, said bulb socket holder member comprising a tubular portion and a pair of integral solid ears extending radially from said tubular portion and having generally flat opposed surfaces, said housing having recesses complementay to said ears, the dimensions of said recesses and said ears being such that said ears substantially fill said recesses, and means for clamping said ears and said recesses against movement between said ears and said recesses, said socket member comprising a tubular section telescoped within said tubular portion of said resilient member, such that upon vibration or shock of said signal lamp, the resiliency in the intermediate portion joining said ears to said tubular portion of said resilient member protects the bulb filament against vibration and shock, an axially extending projection on the outer surface of said tubular section for preventing rotation between said bulb socket holder member and said socket member.

9. In a vehicle signal lamp, the combination comprising a housing having an open end, a lens closing the open end of the housing, a bulb holder assembly comprising a bulb socket holder member of resilient material and a relatively rigid socket member, said bulb socket holder member comprising a cylindrical portion and a pair of integral solid rectangular ears extending radially from said cylindrical portion and joined thereto by an intermediate portion, said ears having generally flat opposed surfaces, said housing having rectangular recesses complementary to said ears, the dimensions of said recesses and said ears being such that said ears substantially fill said recesses, and means for clamping said ears and said recesses against movement between said ears and said recesses comprising plates engaging said ears and fixed to said housing, said ears have grooving in the peripheral edges thereof providing for slight compression of said ears when they are clamped in position, said scoket member comprising a cylindrical section telescoped within said cylindrical portion of said resilient member, such that upon vibration or shock of said signal lamp, the resiliency in the intermediate portion joining said ears to said cylindrical portion of said resilient member protects the bulb filament against vibration and shock, axially extending ears bent downwardly over the one end of said cylindrical portion of said bulb socket holder member, bayonet slots in said socket member extending into said wings such that when said wings are bent downwardly, the open ends of said slots define pin receiving slots for receiving the pin of a bulb.

10. The combination set forth in claim 9 including at least one inwardly extending tab on an opposed end of said tubular section adapted to retain contact members in said tubular section.

11. The combination set forth in claim 9 including at least one tab bent outwardly from the tubular section and extending into a slot in said bulb socket holder for preventing axial movement of said socket member in the opposite direction.

12. In a vehicle signal lamp, the combination comprising a housing having an open end, a lens closing the open end of the housing, a bulb holder assembly comprising a bulb socket holder member of resilient material and a relatively rigid socket member, said bulb socket holder member comprising a cylindrical portion and a pair of integral solid rectangular ears extending radially from said cylindrical portion and joined thereto by an intermediate portion, said ears having generally flat opposed surfaces, said housing having rectangular recesses complementary to said ears, the dimensions of said recesses and said ears being such that said ears substantially fill said recesses, and means for clamping said ears and said recesses against movement between said ears and said recesses comprising plates engaging said ears and fixed to said housing, said ears have grooving in the peripheral edges thereof providing for slight compression of said ears when they are clamped in position, said socket member comprising a cylindrical section telescoped within said cylindrical portion of said resilient member, such that upon vibration or shock of said signal lamp, the resiliency in the intermediate portion joining said ears to said cylindrical portion of said resilient member protects the bulb filament against vibration and shock, an axially extending projection on the inner surface of said tubular section for preventing rotation between said bulb socket holder and said socket member.

13. The combination set forth in claim 1 wherein said ears are in coplanar relation.

14. The combination set forth in claim 1 wherein said ears are generally rectangular.

15. The combination set forth in claim 4 wherein said ears are in coplanar relation.

16. The combination set forth in claim 4 wherein said ears are generally rectangular.

* * * * *